US008469796B2

(12) United States Patent
Shai-Hee

(10) Patent No.: US 8,469,796 B2
(45) Date of Patent: Jun. 25, 2013

(54) GAMING MACHINE AND METHOD WITH A PLURALITY OF FORMATS

(75) Inventor: Michael A. Shai-Hee, Kingsgrove (AU)

(73) Assignee: Aristocrat Technologies Australia Pty Limited (AU)

( * ) Notice: Subject to any disclaimer, the term of this patent is extended or adjusted under 35 U.S.C. 154(b) by 420 days.

(21) Appl. No.: 12/471,906

(22) Filed: May 26, 2009

(65) Prior Publication Data

US 2009/0291745 A1 Nov. 26, 2009

(30) Foreign Application Priority Data

May 26, 2008 (AU) ..... 2008902608

(51) Int. Cl.
*A63F 9/24* (2006.01)

(52) U.S. Cl.
USPC ..... 463/20

(58) Field of Classification Search
USPC ..... 463/20, 43
See application file for complete search history.

(56) References Cited

U.S. PATENT DOCUMENTS

| | | | | |
|---|---|---|---|---|
| 6,336,860 | B1 | 1/2002 | Webb | |
| 6,896,615 | B2 | 5/2005 | Berman | |
| 2002/0065124 | A1 * | 5/2002 | Ainsworth | 463/20 |
| 2004/0092299 | A1 * | 5/2004 | Gauselmann | 463/16 |
| 2005/0107154 | A1 | 5/2005 | Pacey | |
| 2005/0187014 | A1 * | 8/2005 | Saffari et al. | 463/27 |
| 2007/0111782 | A1 * | 5/2007 | Adams et al. | 463/17 |
| 2008/0139293 | A1 * | 6/2008 | Sato | 463/20 |

* cited by examiner

*Primary Examiner* — William D Coleman
*Assistant Examiner* — Christine Enad
(74) *Attorney, Agent, or Firm* — McAndrews, Held & Malloy, Ltd.

(57) ABSTRACT

A gaming system comprises a game controller and a memory storage device comprising game data, the game controller and the memory storage device being arranged such that the game controller can process the game data to effect play of a game. In this gaming system, the play of a game comprises selecting a plurality of symbols and presenting the selected symbols in a plurality of symbol positions that are generally arranged in a plurality of columns, to provide a plurality of game combinations, and wherein the game play comprises a first game component in the form of a line game and a second game component in the form of a game in which for at least one column a plurality of the display positions are designated and the combinations of the game include every possible combination of the designated symbol positions when taking one designated symbol position from each column and wherein less than all of the symbol positions are designated.

33 Claims, 8 Drawing Sheets

GAMING MACHINE AND METHOD WITH A PLURALITY OF FORMATS

RELATED APPLICATIONS

This application claims priority to Australian Provisional Patent Application No. 2008902608 having a filing date of May 26, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention generally relates to gaming machines and methods of gaming. A particular embodiment of the present invention relates to gaming machines that implement a game having a plurality of outcomes.

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

BRIEF SUMMARY OF THE INVENTION

In one aspect, the invention broadly resides in a gaming system comprising a game controller and a memory storage device comprising game data, the game controller and the memory storage device being arranged such that the game controller can process the game data to effect play of a game, wherein the play of a game comprises placing a plurality of symbols in a plurality of symbol positions to create a game outcome, wherein winning outcomes are defined in terms of one or more pay lines associated with the symbol positions; determining whether the game outcome comprises a specified arrangement of at least one symbol; and, if so selecting at least one pay line associated with at least one symbol position; disassociating the at least one pay line from the at least one symbol position; and defining non-pay-line-based winning outcomes for game play that depend on symbols placed in the at least one symbol position.

According to another aspect, the invention broadly resides in a gaming system comprising a game controller and a memory storage device comprising game data, the game controller and the memory storage device being arranged such that the game controller can process the game data to effect play of a game, wherein the play of a game comprises: selecting a plurality of symbols and presenting the selected symbols in a plurality of symbol positions that are generally arranged in a plurality of columns, to provide a plurality of game combinations, and wherein the game play comprises a first game component in the form of a line game and a second game component in the form of a game in which for at least one column a plurality of the display positions are designated and the combinations of the game include every possible combination of the designated symbol positions when taking one designated symbol position from each column and wherein less than all of the symbol positions are designated.

In one embodiment, the first and second game components are integral components of a single game and wherein the gaming system is adapted so that the player can select between different combinations of the first and second game components for a game play of the game In another aspect, the invention broadly resides in a gaming machine that provides a game in which a plurality of symbols are selected and presented on a display and if a winning combination occurs, the gaming machine awards an award, the gaming machine including a user interface in communication with a game controller that implements a base game component and a feature component, wherein the game controller implements the feature following occurrence of the trigger condition during play of the base game, and wherein play of the feature includes: selecting a plurality of symbols and presenting the selected symbols in a plurality of symbol positions that are generally arranged in a plurality of columns, to provide a plurality of game combinations, and wherein the feature is in part a first game component, in which the game combinations include a plurality of pay lines extending across the columns and in part a second game component, in which the combinations include every possible combination of a plurality of designated symbol positions when taking one designated symbol position from each column, wherein each column includes at least one designated symbol position and at least one column includes at least two designated symbol positions and wherein less than all of the symbol positions are designated.

In one embodiment, all of the symbol positions in at least one column are designated symbol positions.

In one embodiment, all of the symbol positions in at least two columns are designated symbol positions.

In one embodiment, there are at least 4 columns of symbol positions in the feature.

In one embodiment, there are 5 columns of symbol positions in the feature.

In one embodiment, the game play is a feature game triggered from a base game, and the base game includes a line game including a plurality of pay lines extending across the symbol positions. In this embodiment, the symbol positions in the base game and the feature may coincide with each other. Also, there may be the same number of symbol positions in the base game and the feature.

In one embodiment, the feature has a plurality of stages, wherein the number of combinations in the game attributable to the second game component is different in the different stages. In this embodiment, the number of combinations in the game attributable to the second game component may increase in the different stages and the return to player increases with the stages. Alternatively, the number of combinations in the game attributable to the second game component increases in the different stages and the return to player remains substantially constant. The stages may be in an order and the feature may be a series of game events and the feature may progress to a next said stage when a trigger condition occurs during the series of game events. Each stage may include every combination from both the first game component and the second game component that existed in all previous stages.

According to another aspect the invention broadly resides in a gaming machine that provides a game in which a plurality of symbols are selected and presented on a display and if a winning combination occurs in the game combinations, the gaming machine awards an award. The gaming machine includes: a user interface in communication with a game controller that implements a base game component and a feature component, wherein the game controller monitors for occurrence of a trigger condition during play of the base game and implements the feature following occurrence of the trigger condition, wherein play of the feature includes selecting a plurality of symbols and presenting the selected symbols in a plurality of symbol positions that are generally arranged in a plurality of columns, to provide for a plurality of game combinations, and wherein the game play comprises a first game component in the form of a line game and a second game component in the form of a game in which for at least one column a plurality of the display positions are designated and the combinations of the game include every possible combination of the designated symbol positions when taking one designated symbol position from each column, and wherein the feature includes a plurality of stages, wherein the number of combinations in the game attributable to the second game component is different in the different stages.

According to another aspect the invention broadly resides in a gaming system comprising a game controller and a memory storage device comprising game data, the game controller and the memory storage device being arranged such that the game controller can process the game data to effect play of a game, wherein the play of a game comprises: selecting a plurality of symbols and presenting the selected symbols in a plurality of symbol positions that are generally arranged in a plurality of columns, to provide a plurality of game combinations, and wherein the game play is in part a first game component, in which the game combinations include a plurality of pay lines extending across the columns and in part a second game component, in which the combinations include every possible combination of a plurality of designated symbol positions when taking one designated symbol position from each column, wherein each column includes at least one designated symbol position and at least one column includes at least two designated symbol positions and wherein less than all of the symbol positions are designated.

In one embodiment, the number of combinations in the game increases in the different stages and the return to player increases with the stages.

In one embodiment, the number of combinations in the game increases in the different stages and the return to player remains substantially constant.

In one embodiment, the stages are in an order and a feature is a series of game events and wherein the feature progresses to a next said stage when a trigger condition occurs during the series of game events.

In one embodiment, the stages are in an order and each stage includes every possible combination from both the first game component and the second game component that existed in all previous stages.

In another aspect, the invention broadly resides in a method for use with a gaming machine that is arranged to select symbols, present the selected symbols on a display and award an award if a winning outcome occurs, the method including: monitoring for occurrence of a trigger condition during play of a game and in response implementing a feature; selecting and displaying on the display in a plurality of symbol positions that are generally arranged in a plurality of columns a plurality of symbols for the feature, to provide a plurality of combinations of symbols; paying an award if a winning combination occurs either along one of a plurality of pay lines defined across the plurality of columns, or in one combination from a set of combinations consisting of every possible combination of a plurality of designated symbol positions when taking one designated symbol position from each column and wherein less than all of the symbol positions are designated and at least two symbol positions are designated in one or more columns.

In one embodiment, there is at least one designated symbol position in every column.

In one embodiment, all of the symbol positions in at least one column are designated symbol positions. In this embodiment, all of the symbol positions in at least two columns may be designated symbol positions.

In one embodiment, the method includes providing a plurality of stages in the feature and varying the number of designated symbol positions between the stages. In this embodiment, the feature may be a series of game events including progressing to a next said stage when a trigger condition occurs during the series of game events. Also, the stages may be in an order and each stage may include every possible combination from both the first game component and the second game component that existed in all previous stages.

According to another aspect, the invention broadly resides in a method for use with a gaming machine that is arranged to select symbols, present the selected symbols on a display and award an award if a winning outcome occurs, the method including: monitoring for occurrence of a trigger condition during play of a game and in response implementing a feature; selecting and displaying on the display in a plurality of symbol positions that are generally arranged in a plurality of columns a plurality of symbols for the feature, to provide a plurality of combinations of symbols; wherein the game play comprises a first game component in the form of a line game and a second game component in the form of a game in which for at least one column a plurality of the display positions are designated and the combinations of the game include every possible combination of the designated symbol positions when taking one designated symbol position from each column; and wherein the feature includes a plurality of stages and the method includes progressing through the stages on occurrence of a feature trigger condition, wherein the number of combinations in the game attributable to the second game component is different in the different stages.

In one embodiment, the number of combinations in the game increases in the different stages and the return to player increases with the stages. In this embodiment, the number of combinations in the game may increase in the different stages and the return to player remains substantially constant.

In one embodiment, the stages may be in an order and each stage includes every possible combination from both the first game component and the second game component that existed in all previous stages.

According to another aspect, the invention broadly resides in a method for use with a gaming machine that is arranged to select symbols, present the selected symbols on a display and award an award if a winning outcome occurs, the method comprising: placing a plurality of symbols in a plurality of symbol positions to create a game outcome, wherein winning outcomes are defined in terms of one or more paylines associated with the symbol positions; determining whether the game outcome comprises a specified arrangement of at least one symbol; and, if so selecting at least one pay line associated with at least one symbol position; disassociating the at least one pay line from the at least one symbol position; and defining non-pay-line-based winning outcomes for game play that depend on symbols placed in the at least one symbol position Further aspects of the present invention and further embodiments of the aspects described in the preceding paragraphs will become apparent from the following description, given by way of example and with reference to the accompanying drawings.

DETAILED DESCRIPTION OF THE INVENTION

Figure 1:
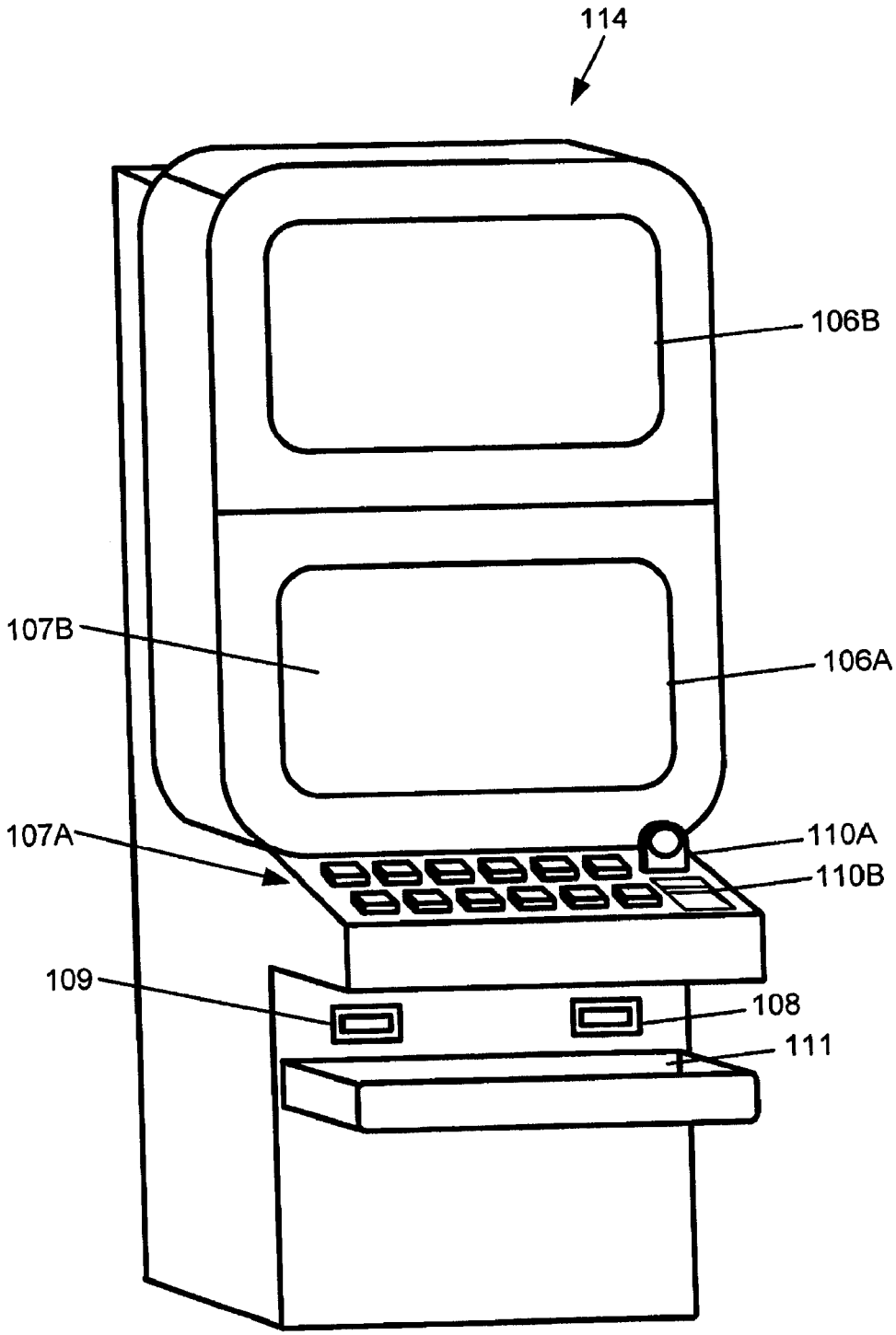
FIG. 1: shows diagrammatically, a view of a gaming console suitable for implementing the present invention.

In FIG. 1 of the accompanying drawings, one example of a gaming console that is suitable to implement the present invention is generally referenced by arrow 114.

The gaming console 114 includes two displays 106A, 106B on one or both of which is displayed representations of a game that can be played by a player and a bank of buttons 107A and/or a touch screen 107B to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
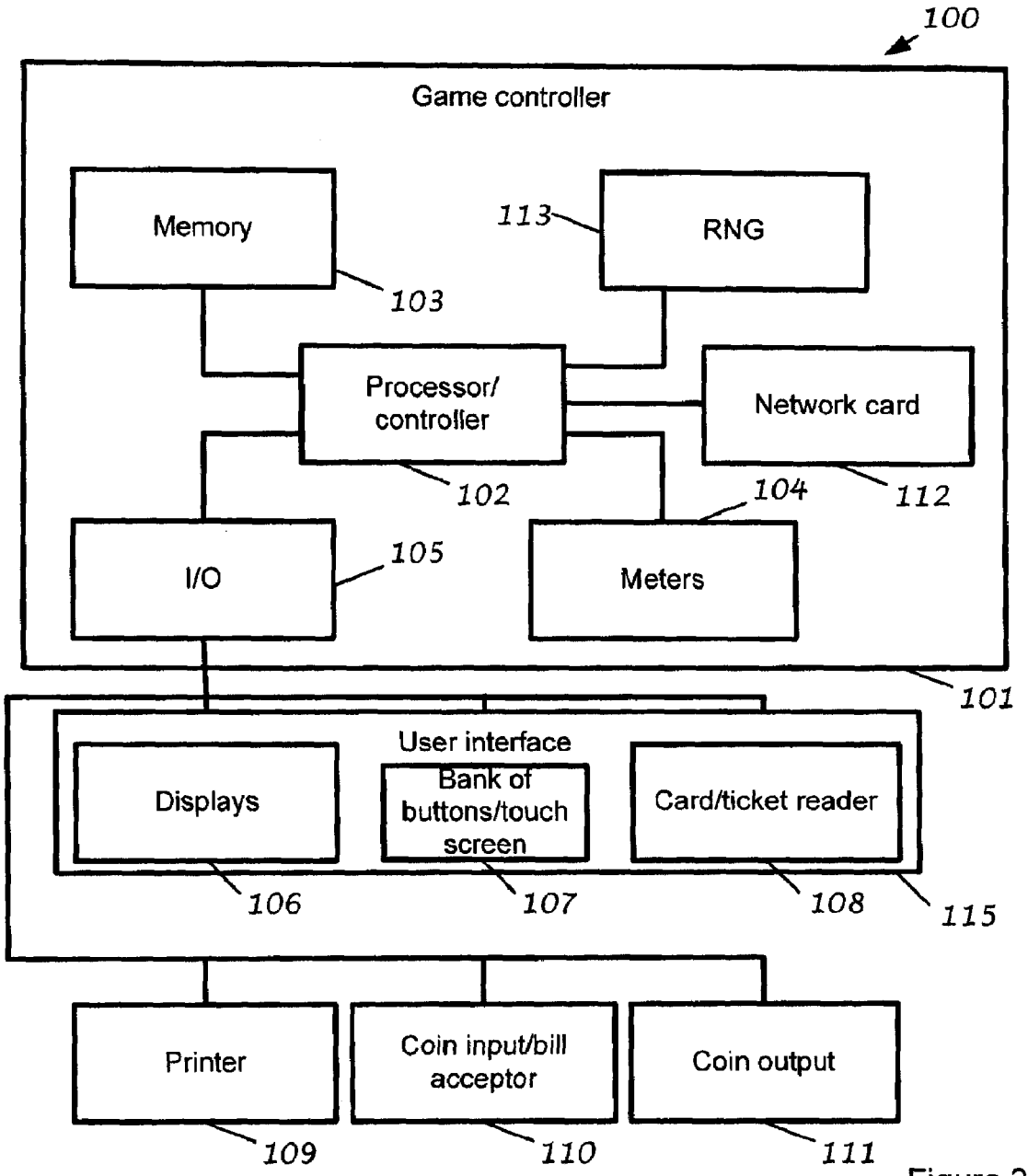
FIG. 2: shows a block diagram of gaming machine suitable for implementing the present invention.

FIG. 2 shows a block diagram of a gaming machine, generally referenced by arrow 100, suitable for implementing the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or some other suitable device. Instructions and data to control operation of the computational device 102 are stored in a memory 103, which is in data communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103. The instructions and data for controlling operation of the computational device 102 may be stored on a computer readable medium from which they are loaded into the gaming machine memory 103. The instructions and data may be conveyed to the gaming machine by means of a data signal in a transmission channel. Examples of such transmission channels include network connections, the Internet or an intranet and wireless communication channels.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, bank of buttons/touch screen 107, the card and/or ticket reader 108, the printer 109, a bill acceptor and/or coin input 110 and a coin output 111. Additional devices may be included as part of the gaming machine 100, or devices omitted as required for the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may include a plurality of devices, which may be local or remote from each other. Instructions and data for controlling the operation of the user interface 115 may be conveyed to the user interface 115 by means of a data signal in a transmission channel. The user interface 115 may be a computational device, for example a personal computer, used by a person to play a game provided from a remote game controller 101.

Figure 3:
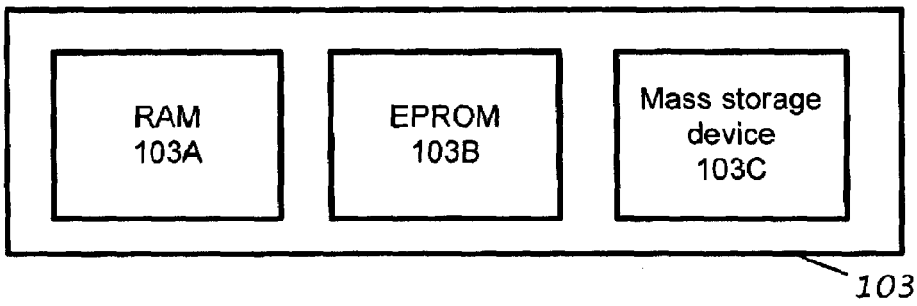
FIG. 3: shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

Figure 4:
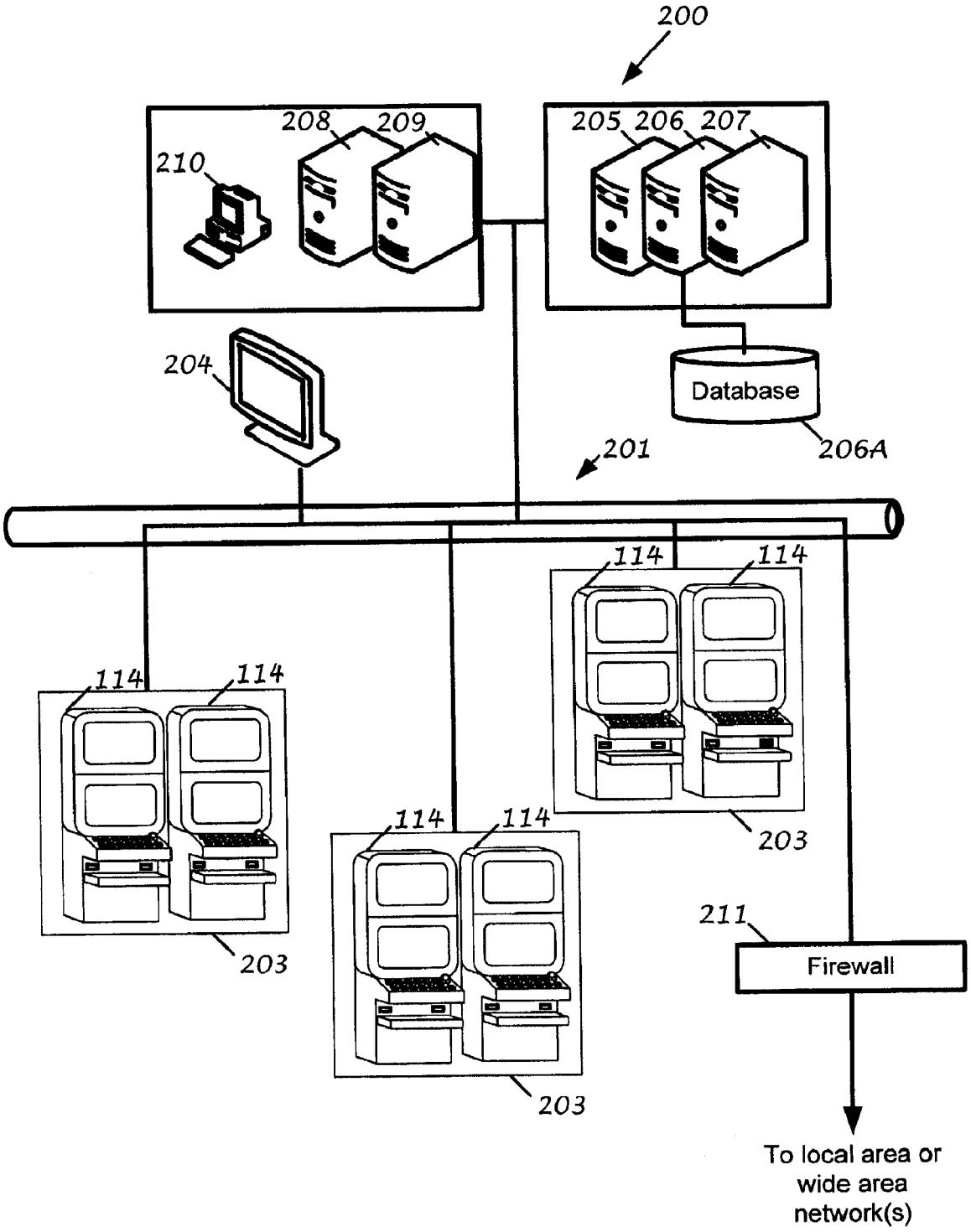
FIG. 4: shows diagrammatically, a network gaming system suitable for implementing the present invention.

FIG. 4 shows a gaming system 200 in the form of a network of devices. The gaming system 200 includes a network infrastructure 201, which for example may be in the form of an Ethernet network. Alternatively, a wireless network and/or direct communication channels, or a different type of network may be used to link the gaming machines to a server, each other and/or other devices. Gaming consoles 114, shown arranged in three banks 203 of two gaming consoles 114 in FIG. 4, are connected to the network infrastructure 201. The gaming consoles 114 may form part or all of a gaming machine 100. Single gaming consoles 114 and banks 203 containing three or more gaming devices 114 may also be connected to the network infrastructure 201, which may also include bank controllers, hubs, routers, bridges to other networks and other devices (not shown).

One or more displays 204 may also be connected to the network 201. The displays 204 may, for example, be associated with a bank 203 of gaming consoles 114. The displays 204 may be used to display representations associated with game play on the gaming devices 114, and/or used to display other representations, for example promotional or informational material.

Servers may also be connected to the network 201. For example, a game server 205 may generate game outcomes for games played on one or more of the gaming consoles 114, a database management server 206 may manage the storage of game programs and associated data in a database 206A so that they are available for downloading to, or access by, game controllers 101, and a jackpot server 207 may control one or more jackpots for the gaming system 200.

Further servers may be provided to assist in the administration of the gaming system 200, including for example a gaming floor management server 208, which may also operate as a player tracking server or a player tracking server may be provided separately, and a licensing server 209 to monitor the use of licenses to particular games. An administrator terminal 210 is provided to allow an administrator to manage the network 201 and the devices connected to the network. The different servers depicted can be distinct physical servers or logically distinct server processes running on a single physical server.

The gaming system 200 may communicate with other gaming systems, other local networks, for example a corporate network and/or a wide area network such as the Internet through a firewall 211.

Spinning reel games are usually categorized into one of two types, line games or Reel Power games, but not combined. Winning outcomes in the two types of game are defined respectively in a pay-line-based manner and a non-pay-line-based manner.

Australian patent number AU 684195 B2 (Crouch) describes the concept of line games including multiple pay lines. The content of this patent is incorporated herein by reference in its entirety. A plurality of reels are represented on a display so as to each display a number of symbols. A common type of spinning reel game has five reels each displaying three symbols, so as to create a 3 by 5 matrix of symbols. Across this matrix of symbols typically anywhere between 3 and 100 pay lines are defined. In a 3 by 5 matrix up to 243 left to right paying lines may be defined, although typically pay-line-based games have less than half of the 243 possible pay lines that could be defined. It is expected that most embodiments of the present invention will have less than 243 pay lines when implementing a line game. The reels are displayed as spinning and stopping in a randomly selected stopping position.

Whether the game play is a winning outcome is represented by whether a winning combination of symbols occurs along any of the pay lines on which the player has staked a wager. The player is often given control over the number of pay lines on which he or she wishes to wager and may also be able to control the number of credits to wager on each pay line. For example, in one game play the player may select to play 1 pay line at 10 credits on the pay line and in another game the player may select to play 10 lines at 1 credit per pay line. Both of these wager options result in a total wager of 10 credits. In a 10 cent denomination machine, each wager therefore costs $1. If a winning symbol combination occurs, then the amount paid to a win meter maintained by the gaming machine is determined by looking up a pay table held in the memory 103. For example the combination may pay 50 credits. In the first example where the player had wagered 10 credits on the pay line, the win meter would be credited by 500 credits. In the second example where the player had wagered 1 credit on the pay line, the win meter would be credited by 50 credits, plus the amount for any other winning combinations that occurred along the other nine pay lines. At the conclusion of the game play, which may for example include a gamble feature in which the player is offered a chance to double the prize or receive no prize, the balance of the win meter is transferred to the credit meter of the gaming machine.

Australian patent number AU 684233 B2 describes a form of the Reel Power type of game in which winning outcomes are non-pay-line-based. The content of this patent is incorporated herein by reference in its entirety. Taking an example of a five reel game where each reel displays three of its symbols when in its stopped position so as to define a 3 by 5 matrix, a player may be given the choice of selecting from between one to five reels, typically working from left to right. If one reel is selected, then each symbol in that reel forms with the symbols along the centre position of the other four reels a combination of symbols on which the player has staked a wager. This results in three different combinations of symbols (based on each of the symbols in the designated reel) and any one or more of those three combinations may indicate that a winning outcome has occurred. If two reels are selected, then any one or more of 9 different combinations of symbols may indicate whether a winning outcome has occurred and so on until all five reels are selected, giving 243 different combinations of symbols.

Both pay-line-based and non-pay-line-based games such as Reel Power games are applicable to spinning reel games having other display formats, including for example six reel games where each reel displays four symbols that can form part of a winning combination. For such a six reel game, the maximum possible number pay lines in a line game or combinations or ways in a Reel Power game is 4096. Other formats may include reels that display a 3 by 3 matrix, a 3 by 4 matrix, a 5 by 4 matrix, as well as others. The format may also be in the form of an array other than a matrix, which is preferably arranged in columns as it is expected that players will view the columns as demonstrating the function of the Reel Power game. However, the columns need not be perfectly vertically aligned. In addition, the symbols displayed in the matrix may be displayed as cards that are dealt, or dice that are spun, or balls that are dropped, rather than symbols that are spun up on a reel. The present invention may also be applied to various display formats, with the following description being given by way of example of a spinning reel game in a 3 by 5 matrix display format.

Embodiments of the invention include a multistage game that progresses from a pay-line-based game into a form of Reel Power game, where the differing concepts of a pay-line game and a non-pay-line-based game coexist together in the one game. The progression may be in a predefined order. Alternatively, the progression may involve a random selection, so that there is a change to another format, but this format may involve more or less outcomes. The expected return to player may be related to the number of outcomes or may be independent of the number of outcomes.

The multistage game may be played as a single game, or it may be implemented as a feature game triggered from a base game by any appropriate method or by two or more different methods. The feature game may be provided as an integral part of the game, or provided separately, for example with a central controller taking control of at least the display of a gaming machine 100 when the trigger condition occurs. The trigger condition may be dependent on the game outcome, such as being the occurrence of a particular combination of symbols, may be dependent on a player action, such as the player paying an ante-bet, or may be a random occurrence unrelated to the outcome of a game play, as in the Hyperlink™ concept from Aristocrat, in which each wager provides a chance of the trigger event occurring, the chance increasing proportionally with the wager. Australian patent application serial number 754689 describes the Hyperlink™ concept, the content of which is incorporated herein by reference in its entirety. Further alternatives include triggering based on a player tracking event, such as the player accumulating a certain amount of wagers, either over all time or over a certain period or the player playing a certain amount of time. Other machine, player-based or system events will be apparent to those skilled in the art, which may be used as a trigger event.

An example of a trigger condition dependent on game outcome may be the display of a particular combination of symbols on the display. For example, the five reels may each carry one or two 'R' symbols and the trigger condition may be the display of three or more 'R' symbols along a pay line in a line game that the player has staked a wager on. Alternatively the 'R' symbols may be 'scattered', so that the trigger condition is when three or more symbols occur anywhere in the 3 by 5 matrix.

Figure 5:
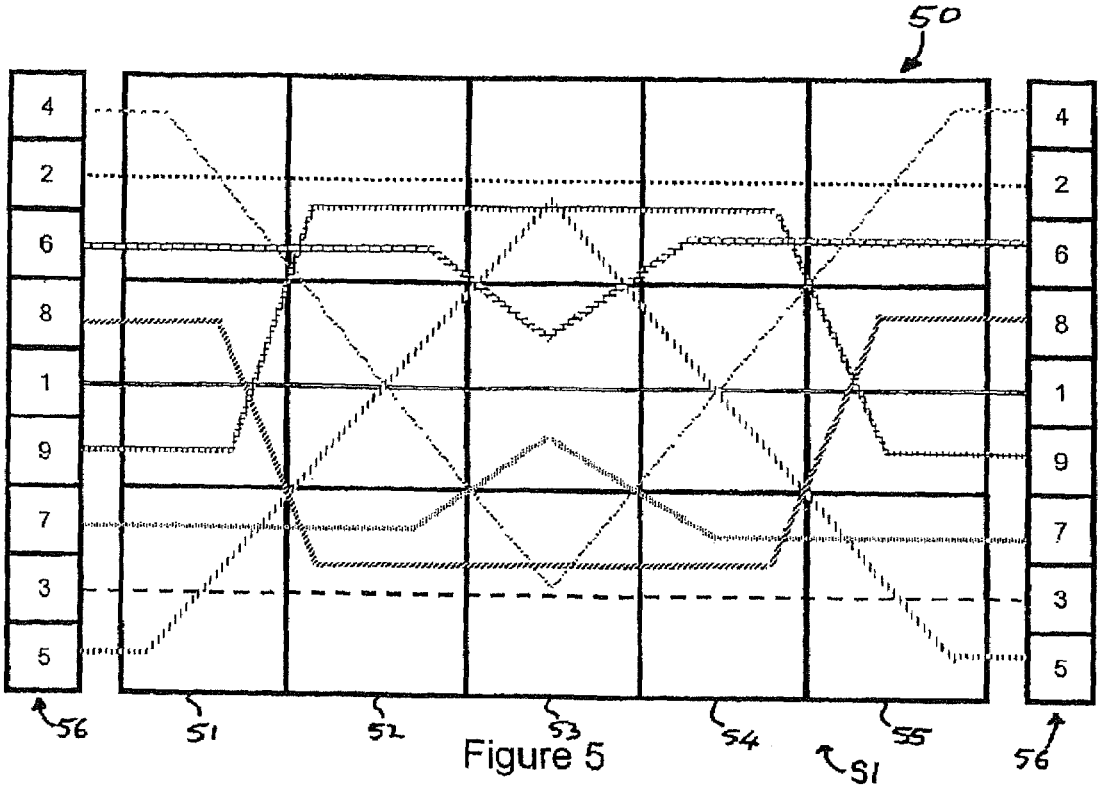
FIG. 5: shows an example of a reel window in an initial stage of a game having 9 pay lines.

FIG. 5 shows diagrammatically an example of a screen shot S1 of a gaming machine 100, implementing a pay-line-based game. In this example, consider a game played with 9 pay lines selected. The pay lines are indicated in FIG. 5 as the lines across a reel window 50 in which five reels 51-55 are displayed. The five reels 51-55 each display three symbols when stopped so as to define a 3 by 5 matrix. Nine win line tabs 56 at the left and right sides of the reel window 50 all light up to indicate that the player has wagered on those nine pay lines.

The spinning reel game is played as per a normal line game, with the symbol combinations from left to right along the pay lines indicating either a winning combination or a losing combination. Other pay conditions may be provided in the game, including for example a right to left pay ability and/or certain symbols may represent a prize if they occur anywhere in the display window 50.

A feature, such as a series of free games, may be triggered during play of the line game due to occurrence of a trigger condition (see herein above) associated with that feature. In one embodiment it is during the feature that the line game changes into a Reel Power game. The form of the Reel Power game that is provided may vary depending on the specific implementation and/or may vary depending on a characteristic of the line game. Characteristics of the line game that may affect the form in which the Reel Power game is provided may include the particular trigger condition that occurred, the wager that was placed by the player, a random selection process, or a combination of two or more of these.

In other embodiments the multistage game described herein forms part of normal game play rather than being a feature triggered from a base game.

In one embodiment, the form of the Reel Power game may vary in progressive stages of the game. For example, a special combination appearing during the game may cause the form of the Reel Power game to change to another stage. The special combination may be the same as, or different to the symbol combination representing the trigger condition for a feature if the trigger condition is a symbol combination. Subsequent occurrences of the same or a different special combination may cause the form of the Reel Power game to change again, so that a progressive change can occur in the Reel Power game, one step at a time. Some game events may cause a change of two or more steps. An example of a stepwise change in the form of a Reel Power game is described below.

The game starts as a line-based game. The line game may be played with the same lines active as the lines on which the player placed a wager in the line game in which the trigger condition occurred. However, in the case of a feature game the reels and/or pay table associated with the game may be changed, for example to increase the expected return to player during play of the feature. Alternatively a fixed number of lines, for example all nine lines may be active regardless of how many lines the player wagered on in the line game in which the trigger condition occurred. Other alternatives are possible, but in general it is expected that the number of lines will be significantly less than maximum number of lines that could be defined across the matrix and in most embodiments significantly less than half of the maximum number of possible lines.

For example, both the base game and the feature may be a line game of the form shown in FIG. 5. In the feature, the game screen may change to indicate that a feature has started. For example, the surrounding area of the display window 50 may change colour, the colour of the reels and/or symbols may change and/or certain sounds may be played. The line game of the feature may have a higher expected return to player, for example due to multiplying the prizes that are won, or due to having a different pay table with different prizes and/or additional or different winning combinations.

Figure 6:
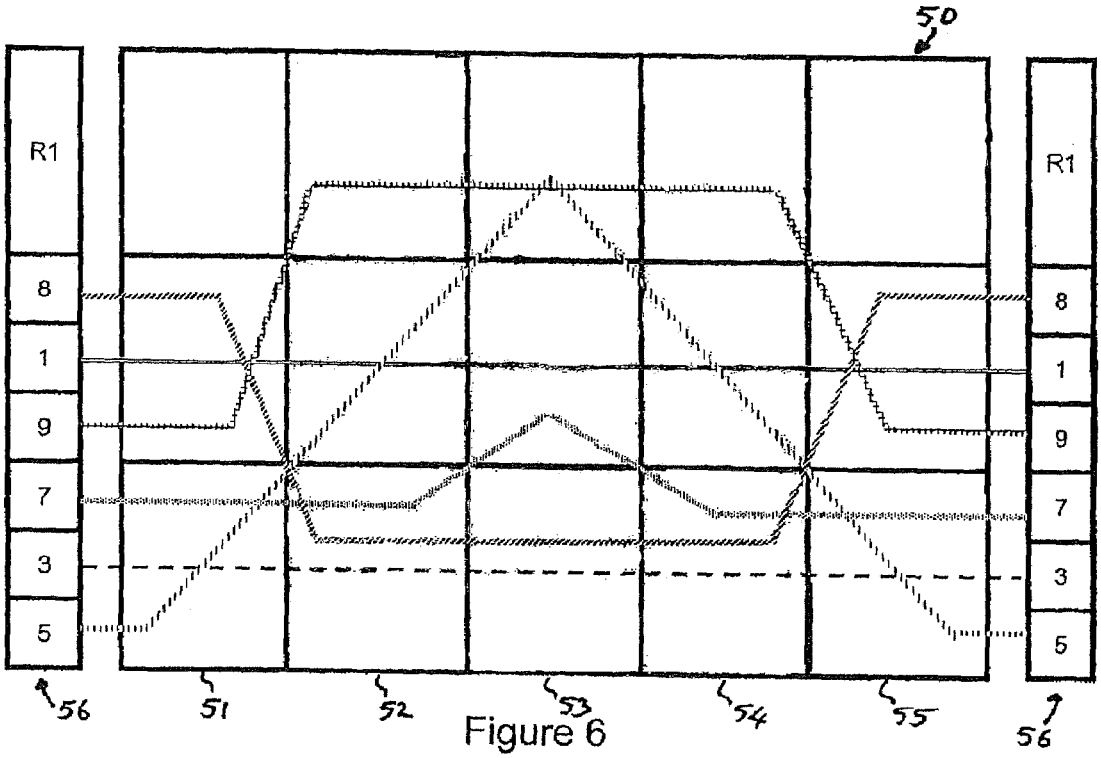
FIG. 6: shows the reel window of FIG. 5 in a stage with 3 paylines disassociated.

When the special combination appears or when the game rules determine that the game should progress to a subsequent stage, win lines 4, 2 and 6 are removed. These lines begin from the top leftmost symbol position in the display window 50 and end at the top rightmost symbol position in the display window 50. Any combinations that start from the top left position will now be treated as a Reel Power combination. In this embodiment the form of Reel Power is that the top leftmost symbol position and the top rightmost symbol position is combined with all combination of symbols formed by taking one symbol from each of the symbol positions in columns 2 to 4 of the 3 by 5 matrix. The other pay lines that start from the middle leftmost symbol position (pay lines 8, 1 and 9) or bottom leftmost symbol position (pay lines 7, 3 and 5), will still be treated as line combinations only. FIG. 6 shows the removed win lines.

Referring to FIG. 6, which shows a second screen shot S2, RI indicates the top row left and top row right end points of the display window 50. The shaded areas show the restricted domain where non-payline-based Reel Power combination wins will be valid. The result is that the game in this stage now defines 33 different combinations and a winning combination can occur in any one or more of the 33 different combinations, 27 from the non-pay-line-based region and 6 pay lines.

The game may be defined so that the game has an increased expected return to player in this stage than when in the previous stage having 9 pay lines. The game need not be changed to effect this, as the 33 different combinations include all nine pay lines from the line game, so that any win that would have occurred in the line game form of the feature will be paid in the combined line and Reel Power form of the feature. There are 24 additional combinations that may define a winning combination in the game form shown in FIG. 6 over the line game shown in FIG. 5.

Instead, in some embodiments the game may change with each step, for example to magnify or reduce the change in return to player that results from the additional combinations. For example, the reels may be varied to provide or more or fewer symbols that form winning combinations, or provide a different distribution of winning symbols, skewed towards higher or lower paying symbols as required to achieve the desired expected return to player.

In some embodiments, by varying the game and/or designing the reel strips and pay lines, a substantially constant expected return to player may be achieved for all stages. In these embodiments, progression through the stages may provide the appearance of providing a higher expected return to player, when in reality it remains constant. In one form, there may be different pay tables associated with each stage and the reels may remain constant, which may lead to a higher number of smaller prizes being paid as the game progresses through the stages. In another form, the reel strips may change and the pay table may remain constant and in yet another form both the reel strips and the pay table may change.

FIGS. 7*a* to 7*f* show examples of what does or does not constitute a winning combination when the game is in the combined line and Reel Power form shown in FIG. 6, assuming that winning combinations are 3 or more of the same symbol read from left to right along a pay line or in a non-line-based region. The reels may carry symbols, which are defined as A=ACE, K=KING, Q=QUEEN, J=JACK, 10=TEN, 9=NINE and W=WILD. A pay table for the game may specify that:

| | | |
|---|---|---|
| 3 × ACE pays 10 credits | 4 × ACE pays 100 credits | 5 × ACE pays 1000 credits |
| 3 × KING pays 5 credits | 4 × KING pays 25 credits | 5 × KING pays 150 credits |
| 3 × QUEEN pays 2 credits | 4 × QUEEN pays 5 credits | 5 × QUEEN pays 20 credits |

Figure 7A:
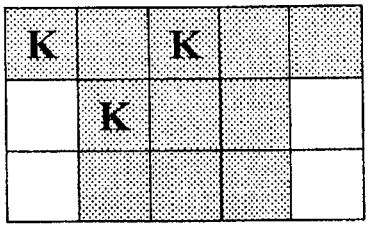
FIGS. 7*a-f*: show examples of winning outcomes in game play using the arrangement of FIG. 6.
Figure 7B:
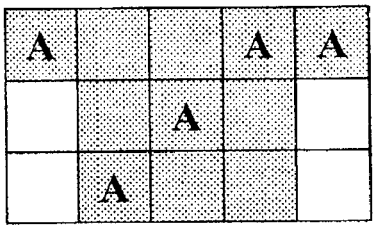
Figure 7C:
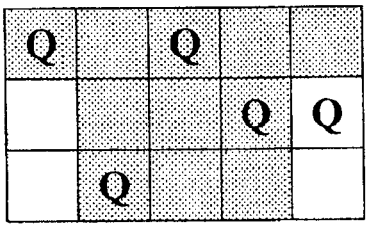
Figure 7D:
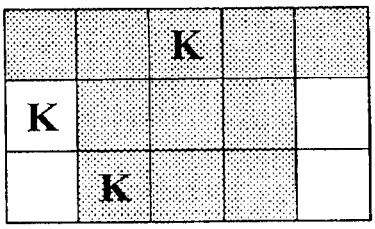
Figure 7E:
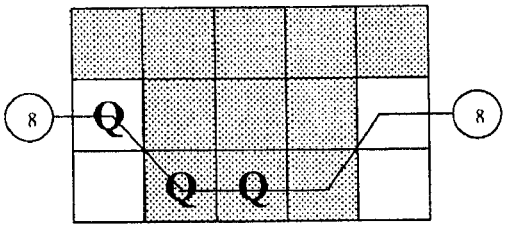
Figure 7F:
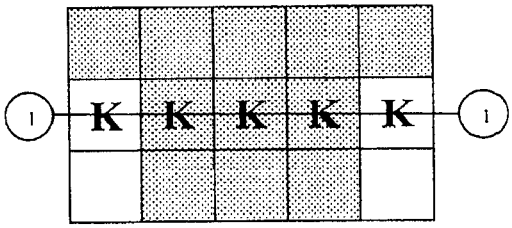

In FIG. 7*a*, a Reel Power win of 3×KING is won because it is within the non-payline-based Reel Power area. The amount paid to the win meter will depend on the rules of the game, for example whether any multiplier is applied due to the player having wagered more than one credit per line when the trigger condition for the feature occurred. For example, if a multiplier is applied and the player wagered 2 credits per line in the line game when the trigger condition occurred, then the win meter would be incremented by 10 credits. In FIG. 7*b* where there is a win of 5×ACE and assuming the same multiplier 2000 credits would be paid to the win meter. In FIG. 7*c*, there is only a win of 4×QUEEN because the fifth QUEEN symbol is outside the shaded area, so that 2×5 credits would be paid. In FIG. 7*d*, there is no win due to the three KING symbols, because the leftmost KING symbol is not within the Reel Power area. FIGS. 7*e* and 7*f* are wins because the 3×QUEEN and 5×KING combinations coincide with win lines 8 and 1 respectively, which have been retained in the feature.

Figure 8:
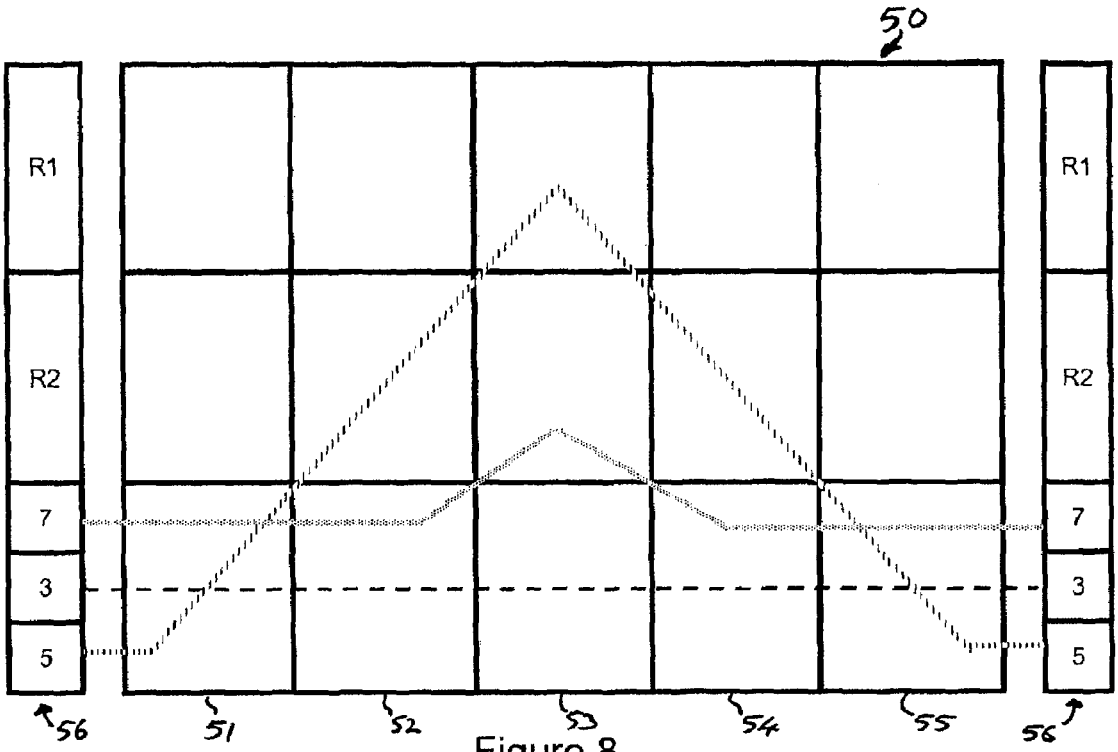
FIG. 8: shows the example of FIG. 6 in a stage with 3 further pay lines disassociated.

When the game progresses to a further stage, for example if a special combination occurs again during the feature, the symbol positions of the middle leftmost and middle rightmost symbol positions become part of the non-pay-line-based Reel Power area as shown in FIG. 8. The result is that the feature now defines 111 different combinations (108 in the Reel Power area plus the remaining pay lines 3, 5 and 7) and a winning combination can occur in any one or more of the 111 different combinations. Again, this may result in an increased expected return to player over both the line game without Reel Power and the combination line game and Reel Power shown in FIG. 6.

Comparing the form of the game shown in FIG. 6 with that shown in FIG. 8, pay lines 8, 1 and 9 have been removed and pay lines 7, 3 and 5 remain. The conditions for the type of combination wins allowed are the same as explained for FIGS. 6 and 7. Every possible combination in the form of the feature shown in FIG. 6 (and FIG. 5) is present in the form shown in FIG. 8, with additional combinations provided, which will increase the expected return to player of the feature if everything else in the feature remains constant. It is expected in many embodiments everything else in the feature will remain constant.

Figure 9:
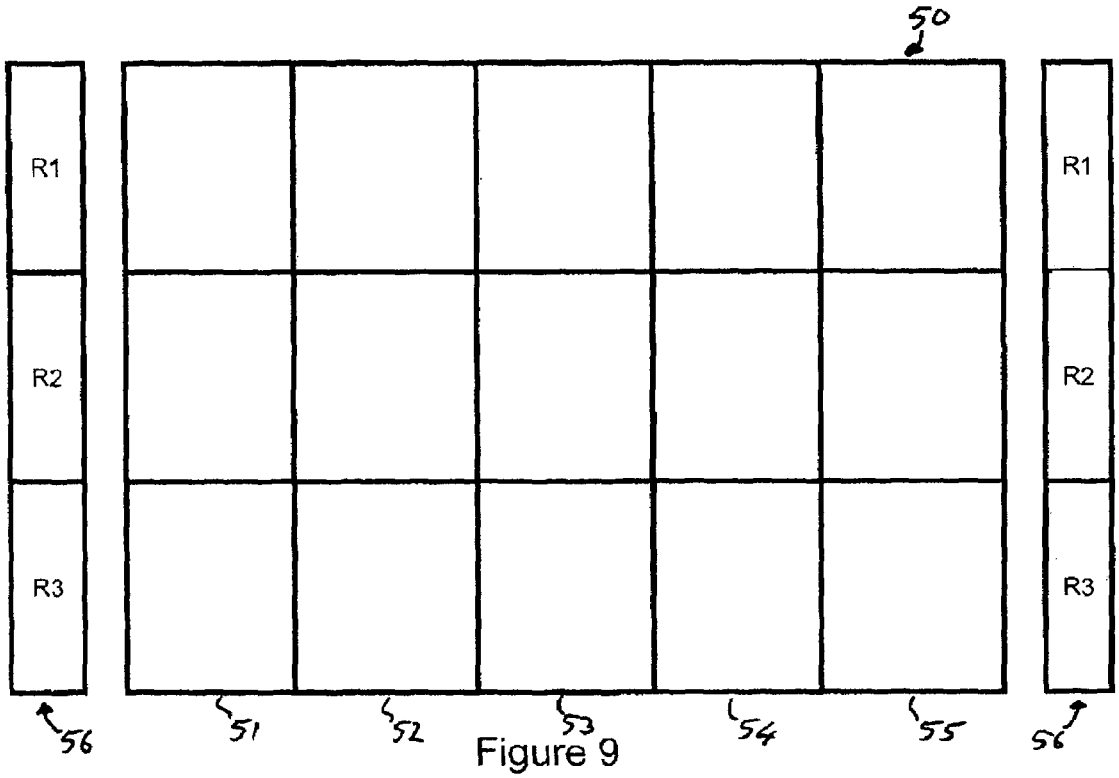
FIG. 9: shows the example of FIG. 8 in a stage with the 3 final pay lines disassociated.

When the next special combination occurs, remaining win lines 7, 3 and 5 are removed and the entire reel window becomes the reel power area as shown in FIG. 9. In this form of Reel Power there are 243 different potential winning combinations, although due to the nature of a spinning reel game if one combination is a winning combination, the layout of the reels will mean that many of the other combinations can not be a winning combination.

Not all symbol locations in columns 52-54 are necessarily designated Reel Power symbol locations. For example, one location may have ordinary pay lines through it, reducing the total number of combinations available. That location may change to a Reel Power symbol on the occurrence of a trigger event, which may or may not be related to the trigger event described herein for progressing through the game stages.

The embodiment described with reference to FIGS. 5 to 9 implements a line game with symmetrical pay lines. In other words the pay lines are a mirror image of themselves about the centre of the third reel. If there are asymmetrical pay lines, then the property described above of each stage in the multi-stage game including every possible combination from every previous stage may not occur. For example, referring to FIG. 10, if the pay line game had a pay line along which the five QUEEN symbols are shown, then changing to the feature shown in FIG. 6 and removing that pay line will mean that the display of five QUEEN symbols in those same positions will only be a win for four QUEEN symbols, not five.

Figure 10:
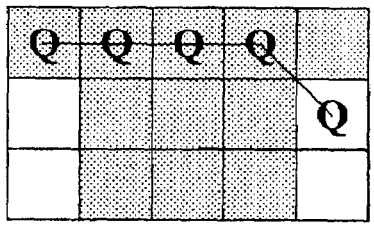
FIG. 10: shows an example using an asymmetrical payline.

More generally, if the game is designed so that all pay lines starting at the Reel Power symbol location are removed and one or more of the removed win line starts within the Reel Power area but ends outside of it, the player may be denied the full win that would have been paid if it occurred along the removed win line. FIG. 10 shows the fifth QUEEN symbol coinciding with the win line part lying outside the shaded reel power area. Only a win of 4×QUEEN will be paid, not the 5×QUEEN prize. This may cause some dissatisfaction or frustration by the player even though the expected return to player may be higher in the changed feature due to a higher number of combinations.

One way to address this issue would be to retain any pay line that would not have an equivalent combination in the combined line and Reel Power game and otherwise retain the same form of Reel Power game. In this embodiment the leftmost upper symbol position forms part of both the Reel Power game and the line game whereas in the embodiment described in relation to FIGS. 5 to 6 the symbols in the leftmost (and rightmost) reels were only ever in one of the line game and the Reel Power game.

Another way to address this issue would be to modify the form of the combined line game and Reel Power game to allow all symbols on the rightmost reel window column to be part of the reel power area. Thus the game would operate as represented diagrammatically in FIGS. 11*a*, 11*b* and 11*c*.

Figure 11A:
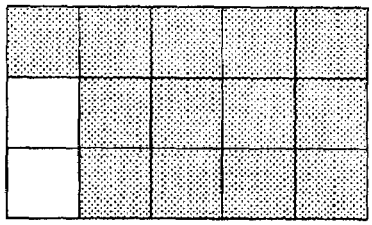
FIGS. 11*a-c*: show an example of three stages in a game in which the changes to the designated region are asymmetrical.
Figure 11B:
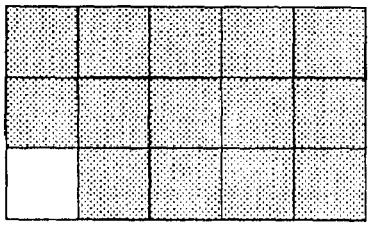
Figure 11C:
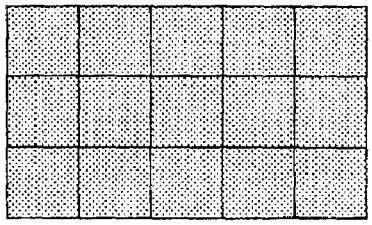

FIG. 11*a* shows the first Reel Power conversion stage, FIG. 11*b* the second and FIG. 11*c* the third Reel Power conversion stage. At every stage, all symbols on the rightmost reel column are part of the Reel Power area.

While the examples shown in FIGS. 5 to 9 showed the Reel Power game encompassing all symbol positions in reels 2 to 4, this is not essential. For example, the bottom most symbol position in reels two and four could be omitted from the Reel Power game shown in FIG. 6. This would result in 12 combinations in the Reel Power game and 6 pay lines in the pay line game of the feature, giving a total of 18 combinations. Because none of pay lines 4, 2 and 6 pass through these symbol positions, this modified form of FIG. 6 does not result in the removal of any combination from the feature and in this example results in twice the number of combinations.

While the foregoing examples of a multistage game started with a line game and progressed to a combined line and Reel Power game, the game may start with a stage of the Reel Power game, for example the stage shown in FIG. 6. In some embodiments the starting stage may depend on the trigger condition from the line game. For example, if three 'R' symbols occurred in the line game, then the feature may start with the line game (FIG. 5), whereas if four 'R' symbols occurred in the line game, then the feature may start with the combined line and Reel Power game of FIG. 6. If more than four 'R' symbols occurred, then the game may progress to further stages in the feature, or may be capped at a certain stage. Similarly, during the feature, the number of special symbols (which may be the same as or different to the 'R' symbols) may indicate how many stages the feature progresses due to their occurrence.

Another example could provide a variable ante-bet, with different levels of ante-bet resulting in commencement at different stages. A further example would be to start the feature at a different stage depending on the number of credits wagered in the base game. If the number of credits wagered affects the level at which the feature starts and the levels have different expected return to players, then in one embodiment the prizes from the feature may not be multiplied by the credits wagered in the base game, and the levels can be designed to reflect the different wagers so as to retain a substantially constant overall return to player attributable to the feature regardless of the wager that the player staked in the base game.

Where the feature is a free game series, the number of free games may be variable. The number of free games may be dependent on, for example, the number trigger symbols that occurred if the trigger condition is the occurrence of a certain number of trigger symbols. For example, three 'R' symbols may result in a 15 game feature, whereas four 'R' symbols may result in a 20 game feature. This change in the number of games in the feature may be made instead of or in addition to other changes, such as the starting stage of the feature as described previously herein.

If the relevant regulations allow, the feature may be a bought feature, in which case the player has to purchase each play of the feature. In a bought feature, the contribution to the overall return to player of the feature may be higher than if the feature is a series of free games.

The feature game may remain at a single stage throughout its duration instead of moving through stages on the occurrence of trigger events. Also, the feature may always start at the same stage. For example, every play of the feature may be a series of free games in the form as shown in one of FIGS. 6, 8, 10, 11*a* and 11*b*.

Further stages may be added to the feature. For example, the stages could step through the feature forms shown in FIGS. 6, 11*a*, 8, 11*b* and 9 to provide 27, 81, 108, 162 and 243 combinations in feature respectively. If this embodiment was adopted and the lines were as shown in FIG. 5, then each subsequent stage would not include all of the combinations from the previous stages. This property may be achieved by changing the line game to add the required additional lines.

The line game may change through the stages independently of any requirement for accumulative addition of combinations without eliminating any previously available combination. For example, referring to FIG. 6 one or more additional lines may be added that start at either of the lower two symbol positions on the reel 51 and in FIG. 8 one or more additional lines may be added that start at the lowest symbol position on the reel 51.

While the foregoing examples of a game had a spinning reel line game as the base game and a spinning reel combined line and Reel Power game as a feature, the base game could be any format of game. For example, it could be a poker style card game, in which case the feature would be a second screen feature having an entirely different format from the base game.

Also, while in the embodiments described the location of the symbol positions for both the base game and feature are the same, the location of the symbol positions may change between the base game and the feature. The feature may have the same, more or fewer number of symbol positions.

In another embodiment, instead of providing a Reel Power form of game that has designated symbol positions extending across all of the columns, the designated symbol positions may extend only part of the way across the columns. For example, referring to FIG. 5, in one embodiment a stage of the feature (which may be the only stage) may convert all the symbol positions for reels 51 to 53 into Reel Power type symbol positions. In this form and again assuming that three or more paying symbols occurring left to right pays a prize, then any three paying symbols occurring in the first three columns will pay a prize. This limits the operation of the Reel Power game to the lower level prizes, leaving the chance of winning the higher level prizes for four or five like symbols exclusively to the line game.

In an alternative embodiment, the line game and the Reel Power type game may be merged instead of played together. Taking again the example where the first three columns are all designated symbol positions for the Reel Power game, then the lines may be eliminated over the first three reels and only come into play for the fourth and fifth reels. In this embodiment, when three like symbols are displayed on the first three reels 51-53, whether a prize for four paying symbols is paid will depend if a like symbol occurs in any position on the display positions for reel 54. If a like symbol is displayed on reel 54, whether a prize for five paying symbols depends on whether a like symbol is displayed on reel 55 along the same pay line 1-9 on which the like symbol on reel 54 is displayed.

In another embodiment of the invention, the line game and Reel Power game may be integrated into a single game. In this embodiment, the player may select the game format to be used. For example, the player may select, using the user interface 115, to play a game in any of the formats as shown in FIGS. 5, 6, 7*a-f*, 8, 9, 10, 11*a*, 11*b* or 11*c* (some of these are equivalent, for example FIGS. 6 and 10). Each of these formats may have a wager associated with them, which is required to be staked to play a game in that format, the wager preferably being related to the expected return to player of that format. With everything else remaining constant, the wager may increase as the number of outcomes defined by the format increases. However, with variation of other game characteristics, such as the pay table, symbol sets and/or game rules, the wager may remain constant or even decrease with an increasing number of outcomes.

In embodiments that implement an integrated line and Reel Power game, the game may still have a trigger event that causes the game to increase to a next stage. For example, if the player can choose between varying formats with different wagers required to be staked for different formats, on the occurrence of a trigger condition in one format, the game may change to another format that would normally require a higher wager, that format giving a higher expected return to player. The change may, for example, occur for the next few games in a bought feature (i.e. the player still has to wager the amount required for the first format), or may occur in a series of free games. If a series of free games is provided, further progression onto other stages may or may not be permitted, depending on the particular game design.

Figure 12:
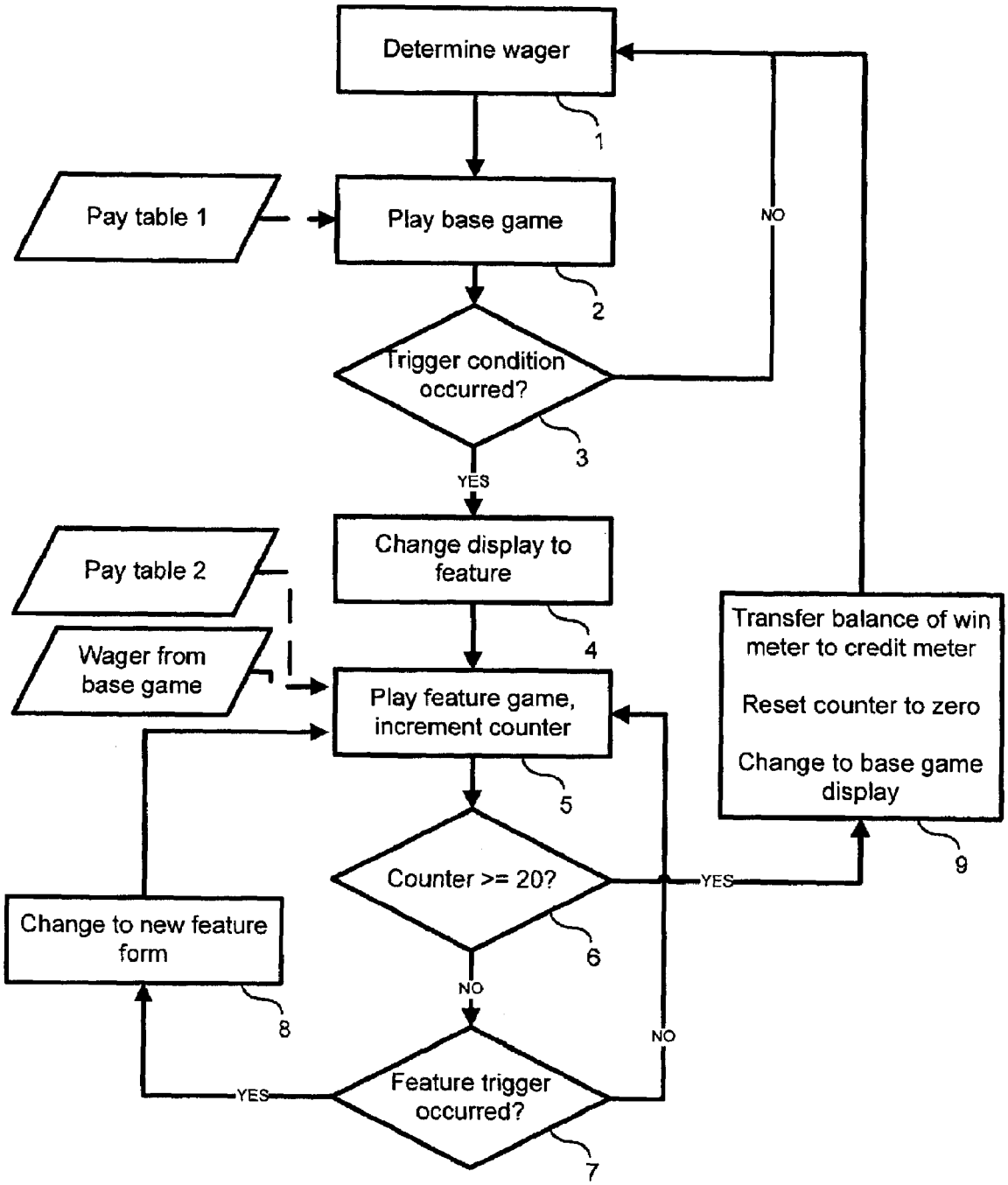
FIG. 12: shows a flow diagram of a process performed in accordance with an embodiment of the present invention.

FIG. 12 shows a process flow diagram of a process performed in accordance with an embodiment of the present invention. The process may be performed by the gaming system 200, in which the gaming consoles 114 each include game controllers 101 to form gaming machines 100 and the following description assumes this implementation. However, those skilled in the relevant arts will appreciate that the process will also be able to be implemented by other gaming systems. The process shows an example of a feature game triggered from a base game in which the feature progresses through the stages described herein with reference to FIGS. 5 to 9, with a symbol-based trigger condition of three or more 'R' symbols occurring from left to right along any one of the pay lines on which the player has placed a wager in the base game. The feature is a 20-game free game series and always commences at the first stage. Prizes from the feature game are multiplied by the wager made on the line in which the trigger condition occurred. The trigger condition for progressing through stages in the feature is three or more 'R' symbols occurring anywhere in the display window and it is not possible to progress more than one stage at a time. The reels remain unchanged, but the pay table of the game changes to a pay table giving a higher expected return to player. Where the game differs from these, the flow diagram will change to reflect the different game design.

As previously mentioned, the multistage game may be played without being triggered from a base game.

In step 1, the game controller 101 monitors the bill acceptor and/or coin input 110 and/or information received by the card/ticket reader 108 or network card 112 for a deposit of credit and in response causes the hardware meters 104 to increment according to the denomination of the game. The game controller 101 then monitors the user interface 107 for the input of a wager.

If there are sufficient credits in the meters 104 to support the wager, a game play is commenced in step 2 under the control of the game controller 101. The game commences with play of the base game component of the game, which is played in accordance with the rules of the game and prizes paid according to a pay table for the base game (pay table 1 in FIG. 12). In this example, the base game is a line game in the form shown in FIG. 5, which includes nine pay lines on which the player may select to place a wager. The player selects both the number of lines to play and the wager per line. For example the player may select between playing 1, 3, 5 or 9 lines and select between wagering 1, 2, 5 or 10 credits per line. Features may be played from the base game other than the feature described herein below, but these are not shown in FIG. 12.

The game controller 101 monitors when during play of the base game three 'R' symbols occur along a pay line that the player has staked a wager on (step 3). When this occurs, in step 4 the game screen displayed on the display 106A changes to display the feature screen. This screen is similar to the screen displayed for the base game, but with differences to show that the feature is in progress. The display 106B may also change, for example to show a video sequence associated with the feature and/or display properties of the feature such as the modified pay table.

In step 5 the feature game is played by spinning the reels 51-55 and showing the reels as stopped in a certain position dependent on input from the RNG 113. Any prizes from the feature are paid to a win meter according to another pay table (pay table 2 in FIG. 12) and a counter is incremented. In step 6 the value of the counter is evaluated and if less than 20 feature games have been played, the process proceeds to step 7.

In step 7 the game controller 101 determines if three or more 'R' symbols have been displayed. If not, the process returns to step 5. If three or more 'R' symbols have been displayed, then the game screen changes and the game controller 101 starts evaluating the new set of combinations for the game, being the combinations described herein with reference to FIG. 6. Play of the feature then continues, with the feature processing through the stages of the feature each time the trigger occurs.

When the counter has reached 20, as determined in step 6, the feature ends and the process proceeds to step 9. The display screen is changed back to the base game display, the counter used in step 6 is reset to zero and the balance of the win meter is transferred to the credit meter, subject to any intervening events such as a gamble feature. The process then returns to step 1.

The probability of occurrence of the feature trigger may be selected according to the design requirements for the game. In one example, the probability may be such that almost all features progress to at least the stage shown in FIG. 6, but that few progress to the stage shown in FIG. 9. However, other distributions may be achieved, which may require modification of the feature trigger as the stages change.

While the foregoing description has been provided by way of example of the preferred embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A gaming system comprising a game controller and a memory storage device comprising game data, the game controller and the memory storage device being arranged such that the game controller can process the game data to effect play of a game, wherein the play of a game comprises:

placing a plurality of symbols in a plurality of symbol positions to create a game outcome, wherein at least one winning outcomes of the game is defined based on at least one of a plurality of paylines associated with the symbol positions;

determining whether the game outcome comprises a predefined arrangement of the symbol; and, if so selecting at least one of the paylines;

removing the selected at least one of the paylines to thereby reduce a total number of the paylines used in the play of the game;

replacing the removed selected at least one of the paylines with a non-pay-line-based criterion such that the at least one winning outcome is defined based on a concurrent use of the plurality of paylines and the non-pay based criterion; and continuing said selecting, said removing and said replacing in subsequent plays of the game until all paylines are replaced with the non-pay-line based criterion.

2. A gaming system comprising a game controller and a memory storage device comprising game data, the game controller and the memory storage device being arranged such that the game controller can process the game data to effect a play of a game, wherein the play of the game comprises:

selecting a plurality of symbols and presenting the selected symbols in a plurality of symbol positions that are generally arranged in a plurality of columns, to provide a plurality of game combinations, and wherein the game play comprises a first game component in the form of a line game wherein at least one winning outcome of the game is defined based on at least one of a plurality of paylines associated with the symbol positions, and a second game component in the form of a game in which for at least one column a plurality of the display positions are designated wherein at least one of the paylines is removed to thereby reduce a total number of paylines, and is replaced with a non-payline-based criterion, and the plurality of game combinations include every possible combination of the designated symbol positions when taking one designated symbol position from each column and wherein less than all of the symbol positions are designated, and wherein a winning outcome is defined based on a concurrent use of the plurality of paylines and the non-payline based criterion; and continuing said selecting, said removing and said replacing in subsequent plays of the game until all paylines are replaced with the non-pay-line based criterion.

3. The gaming system of claim 2, and wherein the first and second game components are integral components of a single game and wherein the gaming system is adapted so that the player can select between different combinations of the first and second game components for a play of the game.

4. The gaming system of claim 2, and wherein all of the symbol positions in at least one column are designated symbol positions.

5. The gaming system of claim 2, and wherein all of the symbol positions in at least two columns are designated symbol positions.

6. The gaming system of claim 2, and wherein there are at least 4 columns of symbol positions.

7. The gaming system of claim 2, and wherein there are 5 columns of symbol positions.

8. The gaming system of claim 2, and wherein the game play is a feature game triggered from a base game and the base game includes a line game including a plurality of pay lines extending across the symbol positions.

9. The gaming system of claim 8, and wherein the symbol positions in the base game and the feature coincide with each other.

10. The gaming system of claim 9, and wherein there are the same number of symbol positions in the base game and the feature.

11. The gaming system of claim 2, and wherein the game play has a plurality of stages, wherein the number of combinations in the game attributable to the second game component is different in the different stages.

12. The gaming system of claim 11, and wherein the number of combinations in the game attributable to the second game component increases in the different stages and the return to player increases with the stages.

13. The gaming system of claim 11, and wherein the number of combinations in the game attributable to the second game component increases in the different stages and the return to player remains substantially constant.

14. The gaming system of claim 11, and wherein the stages are in an order and game play comprises a series of game events and wherein the game progresses to a next said stage when a trigger condition occurs during the series of game events.

15. The gaming system of claim 11, and wherein the stages are in an order and each stage includes every combination from both the first game component and the second game component that existed in all previous stages.

16. A gaming system comprising a game controller and a memory storage device comprising game data, the game controller and the memory storage device being arranged such that the game controller can process the game data to effect a play of a game, wherein the play of the game comprises:

selecting a plurality of symbols and presenting the selected symbols in a plurality of symbol positions that are generally arranged in a plurality of columns, to provide a plurality of game combinations, and wherein the game play is in part a first game component, in which the game combinations include a plurality of pay lines extending across the columns wherein at least one winning outcome of the game is defined based on at least one of the plurality of paylines associated with the symbol positions, and in part a second game component, in which the plurality of game combinations include every possible combination of a plurality of designated symbol positions when taking one designated symbol position from each column, wherein each column includes at least one designated symbol position and at least one column includes at least two designated symbol positions and wherein less than all of the symbol positions are designated wherein at least one of the paylines is removed to thereby reduce a total number of paylines, and is replaced with a non-payline-based criterion, and wherein a winning outcome is defined based on a concurrent use of the plurality of paylines and the non-payline based criterion; and continuing said selecting, said removing and said replacing in subsequent plays of the game until all paylines are replaced with the non-pay-line based criterion.

17. A gaming system that provides a game in which a plurality of symbols are selected and presented on a display and if a winning combination occurs in the game combinations, the gaming system awards an award, the gaming system including a user interface in communication with a game controller that implements a base game component and a feature component, wherein the game controller monitors for occurrence of a trigger condition during play of the base game and implements the feature following occurrence of the trigger condition, wherein the play of the feature includes selecting a plurality of symbols and presenting the selected symbols in a plurality of symbol positions that are generally arranged in a plurality of columns, to provide for a plurality of game combinations, and wherein the game play comprises a first game component in the form of a line game wherein at least one winning outcome of the game is defined based on at least one of a plurality of paylines associated with the symbol positions, and a second game component in the form of a game in which for at least one column a plurality of the display positions are designated and the plurality of game combinations include every possible combination of the designated symbol positions when taking one designated symbol position from each column, wherein at least one of the paylines is removed to thereby reduce a total number of paylines, and is replaced with a non-payline-based criterion, and wherein the feature includes a plurality of stages, wherein the number of combinations in the game attributable to the second game component is different in the different stages, and wherein a winning outcome is defined based on a concurrent use of the plurality of paylines and the non-payline based criterion, and continuing said selecting, said removing and said replacing in subsequent plays of the game until all paylines are replaced with the non-pay-line based criterion.

18. The gaming system of claim 17, and wherein the number of combinations in the game increases in the different stages and the return to player increases with the stages.

19. The gaming system of claim 17, and wherein the number of combinations in the game increases in the different stages and the return to player remains substantially constant.

20. The gaming system of claim 17, and wherein the stages are in an order and a feature is a series of game events and wherein the feature progresses to a next said stage when a trigger condition occurs during the series of game events.

21. The gaming system of claim 17, and wherein the stages are in an order and each stage includes every possible combination from both the first game component and the second game component that existed in all previous stages.

22. A method for use with a gaming machine having a gaming controller that is arranged to select symbols, present the selected symbols on a display and award an award if a winning outcome occurs, the method including:

monitoring via the gaming controller for occurrence of a trigger condition during play of a game and in response implementing a feature;

selecting and displaying via the gaming controller on the display in a plurality of symbol positions that are generally arranged in a plurality of columns a plurality of symbols for the feature, to provide a plurality of combinations of symbols;

selecting at least one of a plurality of paylines on which a winning outcome based on the displayed symbols is defined;

removing the selected at least one of the paylines to thereby reduce a total number of the paylines used in the play of the game;

replacing the removed selected at least one of the paylines with a non-pay-line-based criterion;

paying via the gaming controller an award based on a concurrent use of the plurality of paylines and the non-pay-line based criterion, wherein if a winning combination occurs either along one of a plurality of pay lines defined across the plurality of columns, or in one combination from a set of combinations consisting of every possible combination of a plurality of designated symbol positions when taking one designated symbol position from each column and wherein less than all of the symbol positions are designated and at least two symbol positions are designated in one or more columns; and continuing via the gaming said selecting, said removing and said replacing in subsequent plays of the game until all paylines are replaced with the non-pay-line based criterion.

23. The method of claim 22, and wherein there is at least one designated symbol position in every column.

24. The method of claim 22, and wherein all of the symbol positions in at least one column are designated symbol positions.

25. The method of claim 24, and wherein all of the symbol positions in at least two columns are designated symbol positions.

26. The method of claim 22, and further including providing a plurality of stages in the feature and varying the number of designated symbol positions between the stages.

27. The method of claim 26, and wherein the game is a feature triggered from a base game and the feature is a series of game events including progressing to a next said stage when a trigger condition occurs during the series of game events.

28. The method of claim 27, and wherein the stages are in an order and each stage includes every possible combination from both the first game component and the second game component that existed in all previous stages.

29. A method for use with a gaming machine having a gaming controller that is arranged to select symbols, present the selected symbols on a display and award an award if a winning outcome occurs, the method including:

monitoring via the gaming controller for occurrence of a trigger condition during play of a game and in response implementing a feature;

selecting and displaying via the gaming controller on the display in a plurality of symbol positions that are generally arranged in a plurality of columns a plurality of symbols for the feature, to provide a plurality of combinations of symbols;

wherein the game play comprises a first game component in the form of a line game wherein at least one winning outcome of the game is defined based on at least one of a plurality of paylines associated with the symbol positions, and a second game component in the form of a game in which for at least one column a plurality of the display positions are designated and the plurality of game combinations include every possible combination of the designated symbol positions when taking one designated symbol position from each column wherein at least one of the paylines is removed to thereby reduce a total number of paylines, and is replaced with a non-payline-based criterion, and continuing said selecting, said removing and said replacing in subsequent plays of the game until all paylines are replaced with the non-pay-line based criterion; and wherein the feature includes a plurality of stages and the method includes progressing through the stages on occurrence of a feature trigger condition, wherein the number of combinations in the game attributable to the second game component is different in the different stages, and wherein a winning outcome is defined based on a concurrent use of the plurality of paylines and the non-payline based criterion.

30. The method of claim 29, and wherein the number of combinations in the game increases in the different stages and the return to player increases with the stages.

31. The method of claim 30, and wherein the number of combinations in the game increases in the different stages and the return to player remains substantially constant.

32. The method of claim 29, and wherein the stages are in an order and each stage includes every possible combination from both the first game component and the second game component that existed in all previous stages.

33. A method for use with a gaming machine having a gaming controller that is arranged to select symbols, present the selected symbols on a display and award an award if a winning outcome occurs, the method comprising:

placing via the gaming controller a plurality of symbols in a plurality of symbol positions to create a game outcome, wherein at least one winning outcome of the game is defined based on at least one of a plurality of paylines associated with the symbol positions;

determining via the gaming controller whether the game outcome comprises a predefined arrangement of the symbols; and, if so selecting via the gaming controller at least one of the paylines;

removing the selected at least one of the paylines to thereby reduce a total number of the paylines used in the play the game;

replacing the removed selected at least one of the paylines with a non-pay-line-based criterion such that the at least one winning outcome is defined based on a concurrent use of the plurality of paylines and the non-pay-line based criterion; and continuing said selecting, said removing and said replacing in subsequent plays of the game until all paylines are replaced with the non-pay-line based criterion.

* * * * *

UNITED STATES PATENT AND TRADEMARK OFFICE

CERTIFICATE OF CORRECTION

PATENT NO. : 8,469,796 B2
APPLICATION NO. : 12/471906
DATED : June 25, 2013
INVENTOR(S) : Shai-Hee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 543 days.

Signed and Sealed this
Thirteenth Day of January, 2015

Michelle K. Lee

Michelle K. Lee
*Deputy Director of the United States Patent and Trademark Office*